US005433543A

United States Patent [19]

Sturman

[11] Patent Number: 5,433,543

[45] Date of Patent: Jul. 18, 1995

[54] MEDIA FEED AND CARRIAGE MOTION MECHANISM FOR SHUTTLE-TYPE PRINTERS

[75] Inventor: John Sturman, Vancouver, Wash.

[73] Assignee: Hewlett-Packard Company, Palo Alto, Calif.

[21] Appl. No.: 145,020

[22] Filed: Oct. 29, 1993

[51] Int. Cl.[6] ..... B41J 19/94

[52] U.S. Cl. ..... 400/314; 400/185; 400/568; 400/323

[58] Field of Search ..... 400/185, 187, 313, 314, 400/314.1, 315, 323, 568, 569; 346/134, 136, 139 R; 347/37, 39, 104; 358/296

[56] References Cited

U.S. PATENT DOCUMENTS

| | | | |
|---|---|---|---|
| 4,050,569 | 9/1977 | Crump et al. | 400/314 |
| 4,379,646 | 4/1983 | Maeda | 400/185 |
| 4,402,620 | 9/1983 | Kekas et al. | 400/323 |
| 4,958,949 | 9/1990 | Haftmann et al. | 400/314 |
| 5,000,594 | 3/1991 | Beehler et al. | 400/315 |
| 5,090,827 | 2/1992 | Hirano et al. | 400/185 |
| 5,153,738 | 10/1992 | Stemmle | 400/185 |
| 5,269,613 | 12/1993 | Olson et al. | 400/314 |

FOREIGN PATENT DOCUMENTS

| | | | |
|---|---|---|---|
| 63-212571 | 9/1988 | Japan | 400/314 |

*Primary Examiner*—David A. Wiecking

[57] ABSTRACT

A shuttle-type printer includes a media feed assembly to controllably transfer a recording media through a printing station and a carriage operably mounted at the printing station to move bidirectionally across the media. The printer further includes means mechanically connected to the carriage and media feed assembly for simultaneously (1) moving the carriage and (2) indexing the media through the printing station, whereby the means includes a single motor. Accordingly, a single drive motor can accomplish both carriage motion and media advancement.

11 Claims, 3 Drawing Sheets

FIG. II

MEDIA FEED AND CARRIAGE MOTION MECHANISM FOR SHUTTLE-TYPE PRINTERS

TECHNICAL FIELD

This invention relates to shuttle-type printers.

BACKGROUND OF THE INVENTION

Shuttle-type printers are a class of printers having a movable shuttle or carriage that traverses back and forth across a printing surface. A printhead is mounted on the carriage and synchronized with carriage movement to print desired images. The shuttle class of printers includes both impact printers, such as dot matrix and daisy-wheel printers, and non-impact printers, such as ink-jet printers.

Conventional shuttle-type printers have a media feed assembly which advances a recording media through the printer and a separate shuttle drive assembly which maneuvers the carriage over the recording media. The media feed assembly typically consists of friction rollers or a tractor feed mechanism and a motor coupled to rotate them. The shuttle drive assembly typically consists of a motor and a belt and pulley assembly which connects the carriage to the motor. Common motors used in these assemblies include DC motors which change speed and direction in relation to the level and polarity of DC voltage applied thereto, and stepper motors which change speed and direction in response to intermittent pulses.

The two motors used for the media feed and shuttle drive assemblies are controlled in a synchronized manner. The carriage motor drives the carriage back and forth over the media in periodic swaths. At the end of each swath, the media feed motor increments the recording media within the printer to the next line. Special control circuitry is employed to synchronize the operation of these two motors.

A problem of prior shuttle-type printers concerns the complexity of controlling the independent operation of the media feed motor and the carriage motor. Sophisticated hardware and firmware are necessary to manage both motors. In addition to the cost of each motor, there are extra costs resulting from multiple connectors, logic boards, and cables needed to operate both motors, as well as added power supply requirements.

This invention overcomes the above problem by providing a mechanism for simultaneously moving the carriage and indexing the media by using a single motor. The mechanism thereby eliminates one motor and its associated logic board, connector, cable, and power supply overhead.

DISCLOSURE OF THE INVENTION

According to one aspect of this invention, a mechanism for a shuttle-type printer is disclosed. The shuttle-type printer has a media feed assembly to controllably transfer a recording media through a printing station and a carriage operably mounted at the printing station to move bidirectionally across the media. The unique mechanism for use in the shuttle-type printer includes an indexing means for controllably advancing the recording media through the printing station to position the media relative to the carriage. The indexing means has first and second complementary components that mechanically mate to incrementally move the media. The first complementary component is provided on the media feed assembly and the second complementary component is provided on the carriage. A single drive means is operably connected to the carriage for simultaneously (1) moving the carriage to enable the first and second complementary components to mate, and (2) indexing the media through the printing station when the first and second complementary components mechanically mate.

In the preferred embodiment, the mechanism includes a rotatable axle connected to the media feed assembly, whereby the axle defines a longitudinal axis. A slotted indexing wheel having at least one slot is mounted on the axle. A stationary elongated rod is provided a spaced distance from the axle and a carriage is slidably mounted to the rod to move bidirectionally along the rod and within an actuating proximity relative to the indexing wheel. The mechanism further includes a peg operably mounted on the carriage and dimensioned to slide within the slot of the indexing wheel. A motor is mechanically coupled to the carriage to simultaneously (1) drive the carriage bidirectionally along the rod and within the actuating proximity relative to the indexing wheel, and (2) rotate the axle a selected distance by moving the carriage mounted peg through the slot on the indexing wheel when the carriage is within the actuating proximity of the indexing wheel.

According to one aspect of this invention, the peg is pivotally mounted to the carriage. The peg is supported in an extended position to slide through the slot and rotate the slotted indexing wheel when the carriage is moved in one direction relative to the indexing wheel. Then, the peg pivots-to a retracted position to avoid the slot when the carriage is moved in an opposite direction relative to the indexing wheel.

BRIEF DESCRIPTION OF THE DRAWINGS

Preferred embodiments of the invention are described below with reference to the following accompanying drawings depicting examples embodying the best mode for practicing the invention.

DETAILED DESCRIPTION OF THE PREFERRED EMBODIMENTS

This invention relates to a shuttle-type printer having a media feed assembly and a shuttle assembly. The media feed assembly controllably transfers a recording media sequentially from an initial storage station, through a printing station where text or images are formed on the media, and to a holding station. The shuttle assembly has a printhead supporting carriage mounted at the printing station to move bidirectionally across the media. As the carriage moves, the printhead prints images on the recording media.

Figure 1:
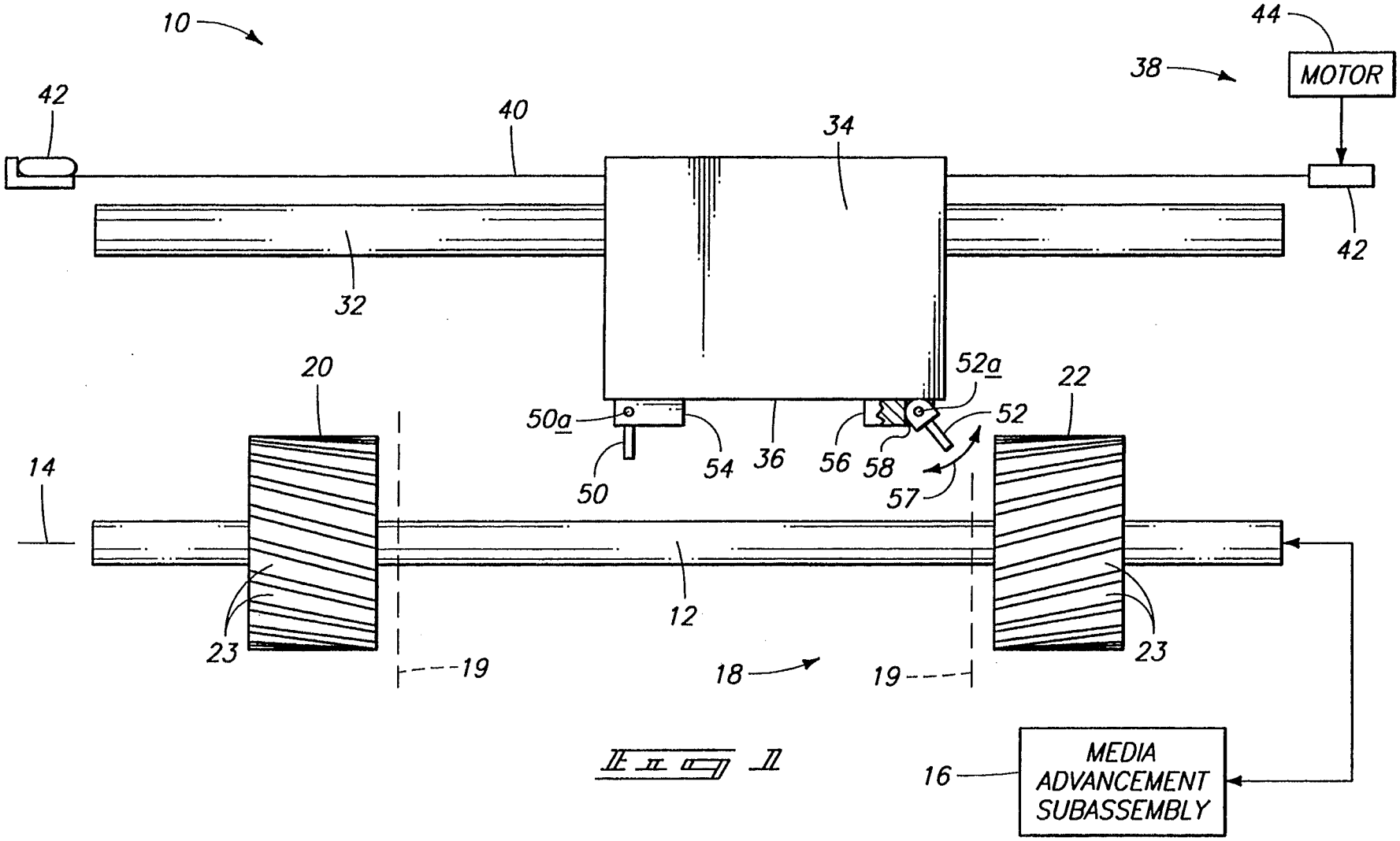
FIG. 1 is a diagrammatic front view of a mechanism for a shuttle-type printer according to this invention.

More particularly, this invention pertains to a unique mechanism that integrates media feed and carriage motion. FIG. 1 shows a media feed and carriage motion mechanism 10 employed in a shuttle-type printer of this invention. Mechanism 10 includes a rotatable axle 12 aligned along a longitudinal axis 14. The rotatable axle 12 is mechanically coupled to a media advancement subassembly 16, such as a pair of friction rollers or a tractor feed system, which together form the mechanical components of a media feed assembly 18. Upon rotation of axle 12, the advancement subassembly 16 moves the recording media through the shuttle-type printer along a media feed path (defined by dashed boundary lines 19). The media may be a continuous form or individual sheet stock, and can consist of paper, adhesive-backed labels, or other types of printable matter.

Mechanism 10 also includes a first slotted indexing wheel 20 fixedly mounted on the left end of axle 12 and a second slotted indexing wheel 22 fixedly mounted on the right end of axle 12. Wheels 20 and 22 are mounted a spaced relationship from one another and preferably positioned outside of media feed path 19. Slotted indexing wheels 20 and 22 have at least one, and preferably multiple, slots 23 formed therein. Most preferably, indexing wheels 20 and 22 are embodied as helical wheels having slots that follow helical paths twisting about axis 14. The orientation of the helical wheels are reversed, for reasons that become apparent from the continuing discussion, as the helical paths wind in opposing directions about the axis 14.

Media feed and carriage motion mechanism 10 has a stationary elongated rod 32 spaced from axle 12 and a carriage 34 slidably mounted to the rod 32 to move bidirectionally over the media. Carriage 34 maneuvers over the full width of the rod to be positionable over central media feed path 19 and within actuating proximity with each of the indexing wheels 20 and 22. Carriage 34 has a nose section 36 that is adjacent to, but spaced from, a platen (not shown), whereby the recording media passes through a small gap between the nose section and the platen. A printhead (not shown) is mounted in the carriage 34 and oriented to position its print elements at the nose section and facing the platen/media. The printhead can be embodied as an ink-jet printhead, a dot matrix printhead, a daisy-wheel, a thermal transfer printhead, or any other type of printhead carried on a shuttle.

A single drive means 38 is mechanically coupled to move carriage 34 back and forth along rod 32. Drive means 38 includes a wire or belt 40 attached to carriage 34 and wound around opposing pulleys 42, and a motor 44 connected to power one of the pulleys. Motor 44 can be a stepper motor or a DC motor. The single drive means is illustrated in its preferred form as having a belt and pulley system, but other configurations may be used. For example, the single drive means may comprise a motor coupled to an elongated screw-type coupling, or as another example, a motor mounted within carriage 34. The rod 32, carriage 34, and drive means 38 comprise the primary components of the shuttle assembly of the printer.

Mechanism 10 includes first and second pegs 50 and 52 mounted to opposing sides of carriage 34. The pegs are connected to pivot about their associated axles 50*a* and 52*a*. Pegs 50, 52 are pivotally held within support members 54 and 56, respectively, provided on nose section 36 of carriage 34. Pegs 50, 52 swing freely through a 90° arc (represented by arrow 57) from an extended, approximately vertical position (as shown by the left peg 50) to a retracted, approximately horizontal position. The pegs normally lie in their extended positions under the force of gravity.

In their extended position, the pegs 50 and 52 operatively engage corresponding indexing wheels 20 and 22 when the carriage 34 is moved over the wheels. The pegs are dimensioned to slide through the slots 23.

Figure 2:
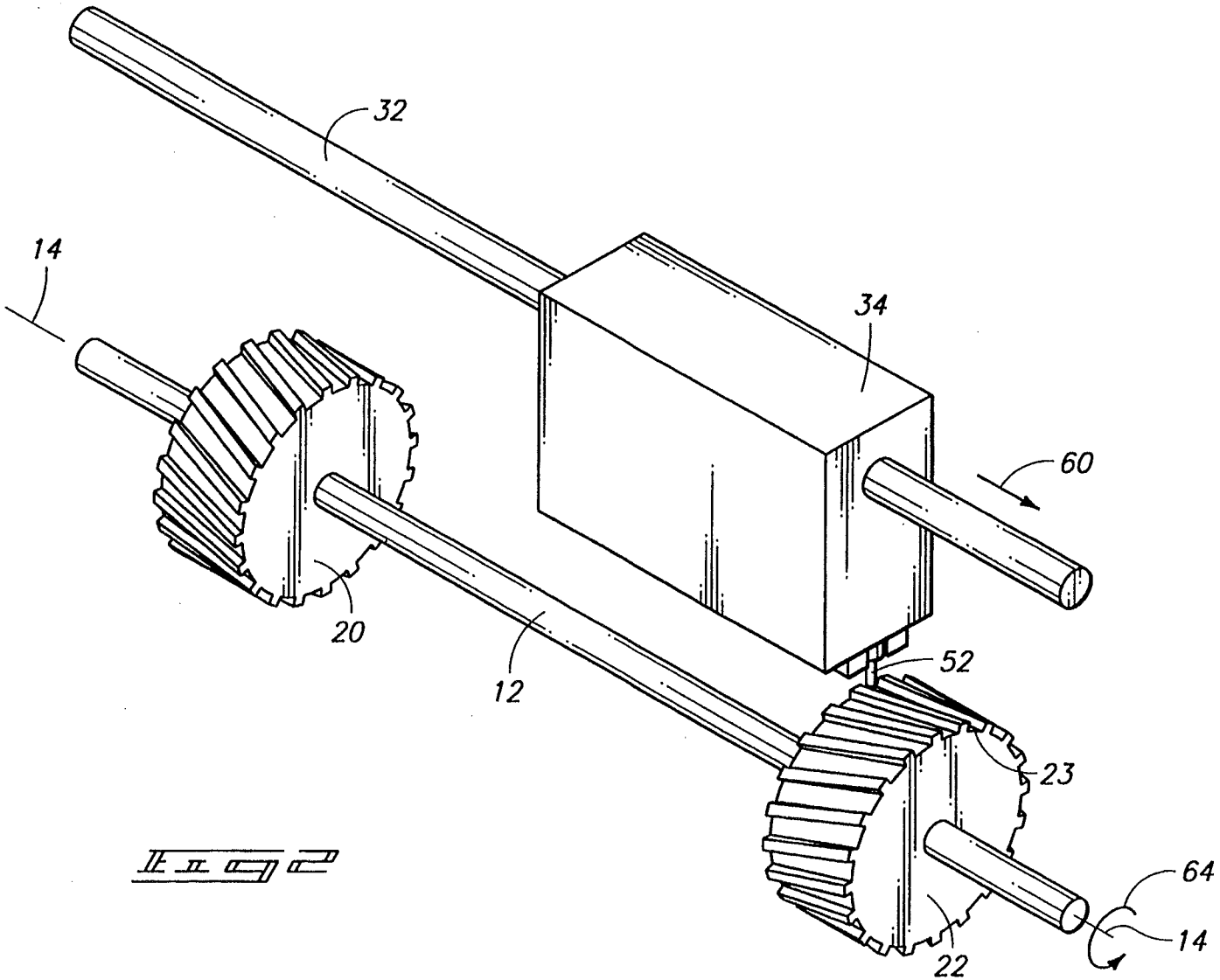
FIG. 2 is a diagrammatic isometric view of the FIG. 1 mechanism illustrating the mechanism at a first operable position.
Figure 3:
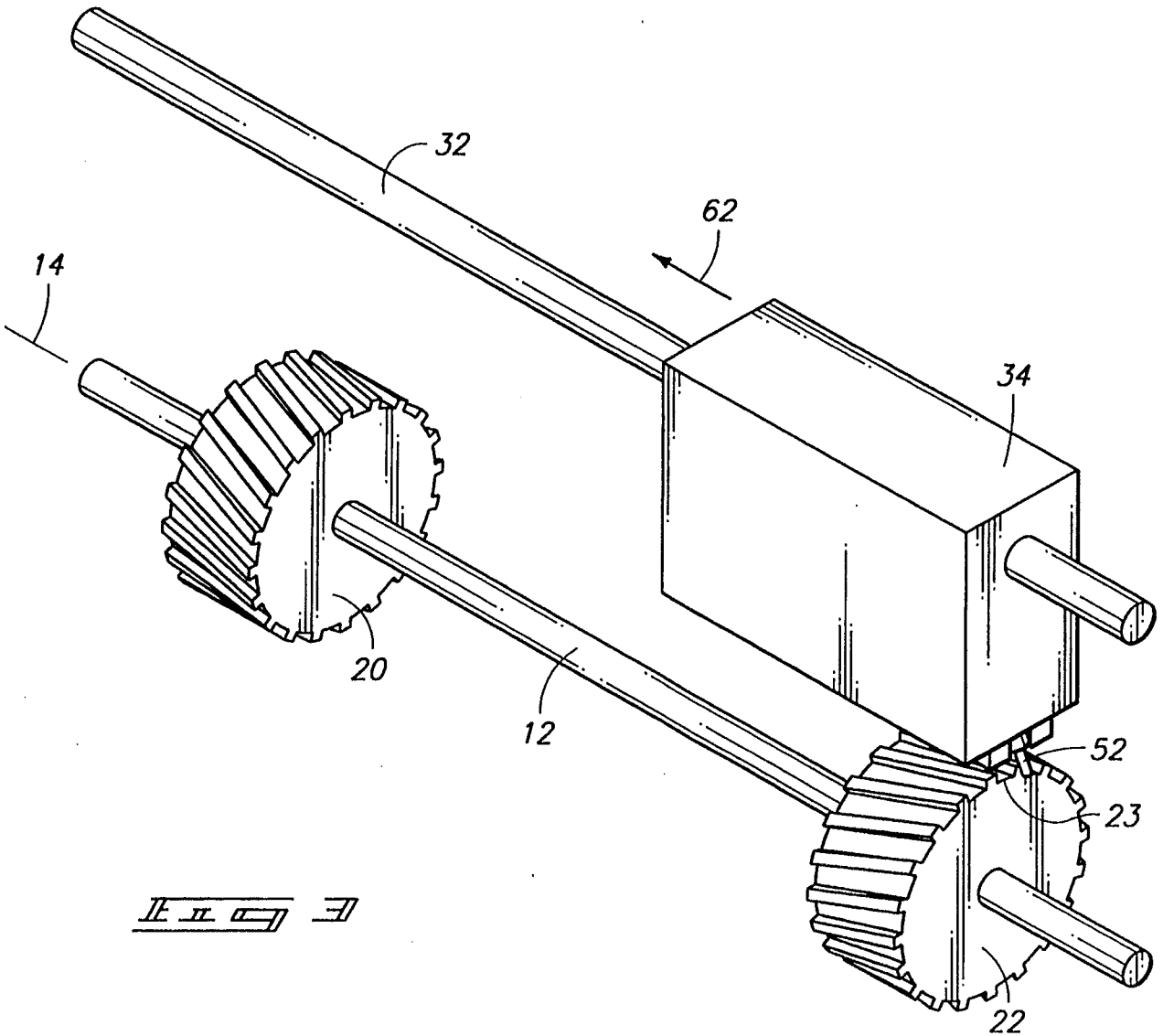
FIG. 3 is a diagrammatic isometric view of the FIG. 1 mechanism illustrating the mechanism at a second operable position subsequent to the position of FIG. 2.

FIGS. 2 and 3 show the interaction of the pegs and indexing wheels in more detail. As carriage 34 completes a swath across the media in the rightward direction (as represented by arrow 60), peg 52 is in its normal extended position as it engages a slot 23. Peg 52 is held in this position by retaining wall 58 of support member 56 (FIG. 1). As carriage 34 continues movement in the rightward direction, peg 52 matingly slides through slot 23 and causes indexing wheel 22 to rotate in a counterclockwise direction about axis 14 (as represented by arrow 64). The force exerted on peg 52 by retaining wall 58 counteracts the inertial and frictional forces imposed by the axle and media feed assembly.

Wheel 22 and axle 12 are rotated a distance equivalent to the offset amount between the entrance and exit of slot 23. Preferably, this rotational distance correlates to indexing a single line of media through the printing station relative to the carriage and printhead for the return swath of the carriage. In this manner, the peg 52 and helical wheel 22 form an indexing means for controllably advancing the recording media through the printing station to position the media relative to the carriage.

When peg 52 has slid completely through slot 23, the carriage 34 can begin a return pass back across the recording media to print a new line of text or images. When the peg abuts wheel 22 in this opposite leftward direction (as represented by arrow 62 in FIG. 3), the peg freely pivots upward to avoid engagement with slot 23. There is no structure to force the peg down into the slot. Accordingly, as the carriage 34 is moved leftward, peg 52 is, simply dragged back across wheel 22 without causing it to rotate.

When the carriage 34 reaches the left side indexing wheel 20, peg 50 mates with a slot 23 and causes the wheel and axle to rotate the prescribed distance as the carriage continues leftward. Then, when the carriage shifts again to the right (arrow 60 in FIG. 2), the peg 50 freely swings upward to an non-engagement position and does not induce the left side indexing wheel 20 to rotate. The reverse pattern of the helical grooves on slotted indexing wheels 20 and 22 enable the mechanism to advance the media in the same direction upon each carriage swath.

It should be appreciated that the helical slots could be reversed and the pegs designed to remain vertical when moving inward across the indexing wheels, as opposed to outward, to rotate the axle and advance the media. Other variations are also possible which are within the purview of a person skilled in the art.

According to the printer of this invention, a single drive motor 44 is used to simultaneously (1) move the carriage bidirectionally along rod 32 over the recording media and helical wheels 20, 22 and (2) index the media through the printing station by causing the pegs 50, 52 to mechanically interface with the helical wheels 20, 22. This structure is advantageous over prior art shuttle-type printers becaiase it eliminates one motor and the associated cable, connector, and logic board. This simplification significantly reduces costs as well as reducing operating complexity. The invention is therefore well suited for incorporation to low-cost, reliable shuttle-type printers.

The preferred embodiment is described as employing a helical wheel and a pivotal peg. In this arrangement, the helical wheel and peg form an indexing means having first and second complementary components that mechanically mate to incrementally move the recording media (via rotating axle 12). Other complementary components may be used to form the indexing means, however, with a first complementary component being provided on the media feed assembly and the second complementary component being provided on the carriage. For example, complementary toothed gears could be used to achieve the indexing rotation.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A mechanism for a shuttle-type printer, comprising:

a rotatable axle connected to incrementally transfer a recording media through the printer upon rotation thereof, the axle defining a longitudinal axis;

at least one slotted indexing wheel provided on the axle, the slotted indexing wheel having at least one slot;

a stationary elongated rod spaced from the axle;

a carriage slidably mounted to the rod to move bidirectionally along the rod and within an actuating proximity relative to the indexing wheel;

a peg pivotally mounted on the carriage and dimensioned to slide within the slot of the indexing wheel; and a motor mechanically coupled to the carriage to simultaneously (1) drive the carriage bidirectionally along the rod and within the actuating proximity relative to the indexing wheel, and (2) rotate the axle a selected distance by moving the carriage mounted peg through the slot on the indexing wheel when the carriage is within the actuating proximity of the indexing wheel, the peg being supported in an extended position to slide through the slot and rotate the slotted indexing wheel when the carriage is moved in one direction relative to the indexing wheel and the peg being pivoted to a retracted position to avoid the slot when the carriage is moved in an opposite direction relative to the indexing wheel.

2. A mechanism according to claim 1 wherein the peg swings freely through a 90° arc from an extended, approximately vertical position for engagement with the slot of the indexing wheel to a retracted, approximately horizontal position for non-engagement with the slot.

3. A mechanism according to claim 1 wherein the slotted indexing wheel comprises a helical wheel having elongated slots that follow helical paths about the longitudinal axis.

4. A mechanism according to claim 1 wherein:

the at least one slotted indexing wheel comprises first and second helical wheels provided in spaced relationship on the axle, the first helical wheel having slots that follow helical paths twisting one direction about the longitudinal axis and the second helical wheel having slots that follow helical paths twisting an opposite direction about the longitudinal axis; and the carriage is configured to slide along the rod to within actuating proximities relative to both the first and second helical wheels to operably slide the peg through slots on both helical wheels.

5. A mechanism according to claim 1 wherein:

the at least one slotted indexing wheel comprises first and second helical wheels provided in spaced relationship on the axle, the first helical wheel having slots that follow helical paths twisting one direction about the longitudinal axis and the second helical wheel having slots that follow helical paths twisting an opposite direction about the longitudinal axis;

the carriage is configured to slide along the rod to within actuating proximities relative to both the first and second helical wheels; and the at least one peg comprises first and second pegs mounted on the carriage, the first peg provided to mate with the slots in the first helical wheel and the second peg provided to mate with the slots in the second helical wheel.

6. A shuttle-type printer incorporating a mechanism according to claim 1.

7. A mechanism for a shuttle-type printer, the shuttle-type printer having a media feed assembly for transferring a recording media through a printing station and having a printhead supporting carriage mounted at the printing station to move bidirectionally across the media, the mechanism comprising:

indexing means for controllably advancing the recording media through the printing station to position the media relative to the carriage, the indexing means having first and second complementary components that mechanically mate to incrementally move the media, the first complementary component comprising a slotted indexing wheel having at least one slot being provided on the media feed assembly and the second complementary component comprising a peg pivotally mounted on the carriage to mechanically engage the slot and rotate the slotted indexing wheel; and single drive means operably connected to the carriage for simultaneously (1) moving the carriage to enable the first and second complementary components to mate, and (2) indexing the media through the printing station when the first and second complementary components mechanically mate;

the peg being supported in an extended position to slide through the slot and rotate the slotted indexing wheel when the carriage is moved in one direction relative to the indexing wheel, and the peg being pivoted to a retracted position to avoid the slot when the carriage is moved in an opposite direction relative to the indexing wheel.

8. A mechanism according to claim 1 wherein the media feed assembly moves the media when the indexing wheel is rotated.

9. A mechanism according to claim 1 wherein the first complementary component comprises a helical wheel mounted on a rotatable axle, the helical wheel having elongated slots that follow helical paths about the axle, the media feed assembly moving the media when the indexing wheel and axle are rotated.

10. A shuttle-type printer incorporating a mechanism according to claim 1.

11. A shuttle-type printer comprising:

a media feed assembly to controllably transfer a recording media through a printing station;

a carriage operably mounted at the printing station to move bidirectionally across the media; and means mechanically connected to the carriage and media feed assembly for simultaneously (1) moving the carriage and (2) indexing the media through the printing station, said means including a single motor, said means further comprising:

a slotted indexing wheel mounted to the media feed assembly, the slotted indexing wheel having at least one slot;

peg pivotally connected to the carriage to slide through the slot and rotate the slotted indexing wheel when the carriage is moved in one direction and to avoid slot when the carriage is moved in an opposite direction;

the means controllably indexing the media through the printing station as the slotted indexing wheel is rotated.

* * * * *